US011077489B2

(12) United States Patent
Huber et al.

(10) Patent No.: US 11,077,489 B2
(45) Date of Patent: Aug. 3, 2021

(54) CORE PACK

(71) Applicant: Bayerische Motoren Werke Aktiengesellschaft, Munich (DE)

(72) Inventors: Manfred Huber, Rottenburg (DE); Thomas Summer, Hohenthann (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 16/536,393

(22) Filed: Aug. 9, 2019

(65) Prior Publication Data

US 2019/0358698 A1 Nov. 28, 2019

Related U.S. Application Data

(63) Continuation of application No. PCT/EP2018/056940, filed on Mar. 20, 2018.

(30) Foreign Application Priority Data

Apr. 6, 2017 (DE) ..... 10 2017 205 853.6

(51) Int. Cl.
*B22C 9/10* (2006.01)
*B22C 9/24* (2006.01)

(52) U.S. Cl.
CPC ..... *B22C 9/103* (2013.01); *B22C 9/108* (2013.01); *B22C 9/24* (2013.01)

(58) Field of Classification Search
CPC ..... B22C 9/10; B22C 9/101; B22C 9/103
See application file for complete search history.

(56) References Cited

U.S. PATENT DOCUMENTS

| | | | | |
|---|---|---|---|---|
| 4,487,246 | A * | 12/1984 | Frasier | B22C 21/14 164/122.2 |
| 10,766,065 | B2 * | 9/2020 | Tallman | B28B 1/24 |
| 2009/0044923 | A1 | 2/2009 | Hanna et al. | |
| 2009/0165298 | A1 | 7/2009 | Nagafuchi | |
| 2013/0264022 | A1 | 10/2013 | Mayer et al. | |
| 2016/0263647 | A1 | 9/2016 | Segaud et al. | |
| 2020/0316677 | A1 * | 10/2020 | Baranzke | B22C 21/14 |

FOREIGN PATENT DOCUMENTS

| | | | |
|---|---|---|---|
| CN | 101400462 | A | 4/2009 |
| CN | 101367125 | B | 7/2011 |
| CN | 102985675 | A | 3/2013 |
| CN | 104373241 | A | 2/2015 |
| CN | 104439089 | A | 3/2015 |
| CN | 105828975 | A | 8/2016 |

(Continued)

OTHER PUBLICATIONS

Deore et al., "A Study of Core and its Types for Casting Process", International Journal of Advanced Technology in Engineering and Science, Mar. 2015, pp. 1571-1580, vol. 3, Nol. 1, XP-002780680, (11 pages).

(Continued)

*Primary Examiner* — Kevin E Yoon
(74) *Attorney, Agent, or Firm* — Crowell & Moring LLP

(57) ABSTRACT

A core pack has at least two cores. The cores have chaplet sections that are oriented relative to one another and form a print. A chaplet is or can be placed on and/or against the print, thus allowing the cores to be secured relative to one another.

12 Claims, 1 Drawing Sheet

(56) References Cited

FOREIGN PATENT DOCUMENTS

| | | | |
|---|---|---|---|
| CN | 205816726 | U | 12/2016 |
| DE | 394018 | C | 4/1924 |
| DE | 93 15 991 | U1 | 3/1994 |
| DE | 297 17 661 | U1 | 1/1999 |
| DE | 100 00 149 | A1 | 7/2001 |
| JP | 62-263846 | A | 11/1987 |
| WO | WO 2007/105108 | A2 | 9/2007 |

OTHER PUBLICATIONS

Chinese-language Office Action issued in Chinese Application No. 201880014128.X dated Apr. 26, 2020 with English translation (17 pages).
International Search Report (PCT/ISA/210) issued in PCT Application No. PCT/EP2018/056940 dated May 16, 2018 with English translation (six (6) pages).
German-language Written Opinion (PCT/ISA/237) issued in PCT Application No. PCT/EP2018/056940 dated May 16, 2018 (six (6) pages).
German-language Search Report issued in counterpart German Application No. 102017205853.6 dated May 8, 2017 with partial English translation (11 pages).
Chinese-language Office Action issued in Chinese Application No. 201880014128.X dated Dec. 11, 2020 with English translation (19 pages).
Ailian, G. et al., "Basic Foundry Technology", 1st Edition, Oct. 31, 1997, p. 303, Beijing: Jindun Press (two (2) pages).
"Intermediate Foundry Technology", 1st Edition, Machinery Industry Vocational Skills Appraisal and Guidance Center, Aug. 31, 2007, p. 72, Beijing: China Machine Press (two (2) pages).

* cited by examiner

CORE PACK

CROSS REFERENCE TO RELATED APPLICATIONS

This application is a continuation of PCT International Application No. PCT/EP2018/056940, filed Mar. 20, 2018, which claims priority under 35 U.S.C. § 119 from German Patent Application No. 10 2017 205 853.6, filed Apr. 6, 2017, the entire disclosures of which are herein expressly incorporated by reference.

BACKGROUND AND SUMMARY OF THE INVENTION

The present invention relates to a core pack, to a casting mold, and to a method for producing a casting.

The castings in this context are, for example, cylinder heads of internal combustion engines. Components of this type are produced, for example, by gravity casting and require core packs of complex design in order for the later cooling spaces or cooling lines, respectively, for water or oil, etc., to be reproduced in the casting. In order for the cores to be fixed when casting and for any floating of said cores to be prevented, the cores have to be held down or fixed, respectively, wherein said fixing can be performed, for example, by way of the gravity die slides on core bearings of the cores, said core bearings being correspondingly configured. However, openings which have to be post-machined with great complexity are created on account thereof in the later casting. Openings of this type in the finished casting are closed off by way of closure screws or caps, for example. However, this is preceded by complex machining comprising, for example, milling, thread cutting, etc. What remains problematic is that leakages often occur when using such closure screws or caps.

It is therefore an object of the present invention to provide a core pack, a casting mold, and a method for producing a casting which simplify the overall process while enhancing the quality of the castings and simultaneously reducing costs.

This object is achieved by a core pack, by a casting mold, and by a method according to the claimed invention.

According to the invention, a core pack comprises at least two cores, wherein the cores have mutually oriented chaplet portions which form a print (disposed portion), and wherein a chaplet element is disposed or capable of being disposed on top of and/or on the print, on account of which the cores can be mutually fixed. The term "fixing" herein is in particular to be understood as mutual holding or else compressing. Mutually oriented means that the chaplet portions, in particular, bear on one another or are in mutual contact, at least in regions, respectively. At least two chaplet portions herein preferably always form one print. The great advantage lies in that a contiguous core pack can be shaped/formed, wherein any floating of the core pack when casting in the casting mold can already be prevented on account of the total weight created hereby. Additionally or alternatively, the possibility that, for example, only one of the cores of the core pack has to configure or comprise, respectively, a core bearing, or has to be otherwise fixed, respectively, is moreover created on account thereof. In summary, fewer down-holding members thus expediently suffice for counteracting the buoyancy, for example. The use of separate down-holding members or separate core bearings can optionally even be completely dispensed with. A holding force of the chaplet element acts in particular as a compression force on the print. Depending on the design embodiment of the print which can be round or angular in the cross section, for example, the compression force acts in particular in a radial manner and, depending on the design embodiment of the chaplet element, in a fully circumferential radial manner in particular when the chaplet element comprises the print in a fully circumferential manner. On account thereof, an extremely uniform and smooth introduction of force can be achieved, this being particularly advantageous in the case of the sand cores which are sensitive per se. The cores are in particular sand cores produced by the hot box or cold box method, for example.

According to one embodiment, the chaplet element is conceived for the form-fitting and/or force-fitting disposal. An internal contour of the chaplet element preferably corresponds entirely or substantially, respectively, to an external contour of the print, on account of which a form-fit results. Additionally or alternatively, a force-fit can also be provided, on account of which active mutual compressing or fixing, respectively, of the cores by way of the chaplet element can be performed. In other words, the cores are mutually pretensioned, so to speak. Depending on the use or the method management, respectively, it may also suffice for the actual holding force to ultimately act only when the cores would "attempt" to reposition themselves when casting. The chaplet element can thus also be, or have been, respectively, only push-fitted in a "loose" manner.

According to one embodiment, the chaplet element is elastic. The elasticity can be provided by the shape or design embodiment, respectively, of the chaplet element, or else by a corresponding choice of material. An elastically configured chaplet element can advantageously be used on prints of dissimilar sizes. However, the holding force can also be built up on account of the elasticity, as has been described above.

According to one embodiment, a dimension, in particular a diameter, of the chaplet element, is capable of being set. As has already been indicated, this is enabled, for example, by way of the elasticity or a deformation capability, respectively, or by way of a corresponding geometric design embodiment.

According to one preferred embodiment, the chaplet element is ring-shaped; the chaplet element is in particular annular. This herein can be a closed or an open ring.

According to one embodiment, the chaplet element is a spring ring. The spring ring is in particular a ring which is not closed, on account of which a deformation capability, or a elasticity or mobility, respectively, is achieved. This enables an adaptation to disposal regions of dissimilar dimensions, on the one hand. Moreover, a chaplet element which can apply pretensioning to the respective print is provided.

According to one embodiment, a material/raw material of the chaplet element corresponds to a casting raw material, or corresponds at least substantially to the casting raw material, respectively. The casting material/casting raw material is, for example, an aluminum raw material, in particular an aluminum alloy, or a magnesium alloy. The chaplet element can advantageously become a component part of the later casting. For improved recasting or pouring, respectively, the chaplet element according to one embodiment can be provided with a corresponding coating, wherein the composition of said coating depends on the casting raw material used.

Alternatively, the raw material of the chaplet element is selected with the view to influencing the component properties of the later casting in a targeted manner. An influence can be chosen such that an increase in terms of rigidity, or a targeted weight reduction in regions, etc., is provided by the chaplet element, in particular by a suitable material selection.

According to one embodiment, a melting temperature or an evaporating temperature of the raw material of the chaplet element is conceived so as to be below a melting temperature of the casting raw material. The chaplet element can thus melt or evaporate, for example, in other words, can thus "vanish" or dissolve, respectively, during the actual casting process. This procedure herein is expediently designed such that regions or portions of the melt are already at least solidified to the extent that any holding of the core or cores by the chaplet element, or by the chaplet elements, respectively, is no longer required.

According to one preferred embodiment, the chaplet portions in the cross section are configured so as to be circle-segment-shaped. Two chaplet portions mutually oriented in such a manner, advantageously shape an oval, or approximately oval, respectively, or round, in particular circular, print. As has already been indicated, the print in the cross section can also be configured so as to be angular, for example quadrangular such as square or rectangular, or else, polygonal, respectively. The avoidance of edges herein is particularly advantageous because very gentle fixing, or even compressing, respectively, can be performed by the chaplet elements on account thereof.

According to one embodiment, the print is configured as an appendage. This is in particular an appendage which extends perpendicularly, or substantially perpendicularly, respectively, away from the actual external contour of the respective core.

The core pack preferably comprises a plurality of prints, for example, 2, 3, 4, 5, or more. The number and position depends on the geometry and the dimensions of the respective component.

According to one embodiment, a length-to-diameter ratio of the appendage is less than 1, in particular less than 0.6. According to various embodiments, a length of the appendage is, for example, 3-10 mm, preferably approximately 5-8 mm, while a diameter is approximately 10-40 mm, in particular, approximately 15-30 mm. The dimensional details stated enable reliable mutual fixing of the cores by the chaplet element, in particular on account of the circumferential face of the print thus created.

According to one preferred embodiment, the core pack is a core pack of a cylinder head of an internal combustion engine. A core pack of this type comprises, for example, a water cooling jacket core and an oil chamber core.

It is to be mentioned at this point that the core pack can also comprise more than two cores, for example, three, four, five, or more cores, wherein said cores among one another can be mutually fixed by way of correspondingly disposed chaplet portions.

The invention also relates to a casting mold, comprising at least one core pack according to the invention.

The casting mold per se can be a lost mold such as a sand casting mold, or else a permanent mold such as a permanent die. This is in particular a casting mold for low-pressure casting or gravity casting, or for pure sand casting, respectively, or for chill casting.

A down-holding member is preferably disposed or provided, respectively, only on one of the cores.

According to one embodiment, at least one of the cores in terms of the direction of gravity is a lower core, and wherein at least one of the cores in terms of the direction of gravity is an upper core, and wherein a down-holding member is provided or disposed, respectively, only on the lower core. The core pack advantageously enables only one of the cores, in particular the lower core, for example, to be per se fixed relative to the casting mold. The core pack per se is expediently inherently, or mutually, respectively, fixed in such a manner that no further holding, for example from above, is required.

The invention also relates to a method for producing a casting, in particular a cylinder head of an internal combustion engine, comprising the following steps:

- providing at least two cores which are conceived for shaping cavities in the later casting;
- mutually fixing the at least two cores by way of at least one chaplet element;
- disposing the core pack in a casting mold and fixing a core relative to the casting mold.

According to one embodiment, only one of the cores, or in particular, only the lower core, for example, or one of the lower cores, respectively, is fixed relative to the casting mold.

The overall production costs can be significantly reduced by way of the core pack, the casting mold, and by way of the method, while simultaneously increasing the production rate. The machining of the core bearing openings of raw parts or finished parts, respectively, can largely be dispensed with; the same applies to the assembly of any potential closure elements, such as caps, screws, expanders, etc. Moreover, it is possible for casting material to be saved, in particular since the cores do not have to comprise any, or have to comprise fewer, respectively, separate core bearings. The tightness problems in the case of the subsequent closing of the core bearing openings, mentioned at the outset, are advantageously completely dispensed with as a matter of principle.

The advantages and features mentioned in the context of the core pack apply in an analogous and corresponding manner to the casting mold as well as to the method, and vice versa as well is in combination.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
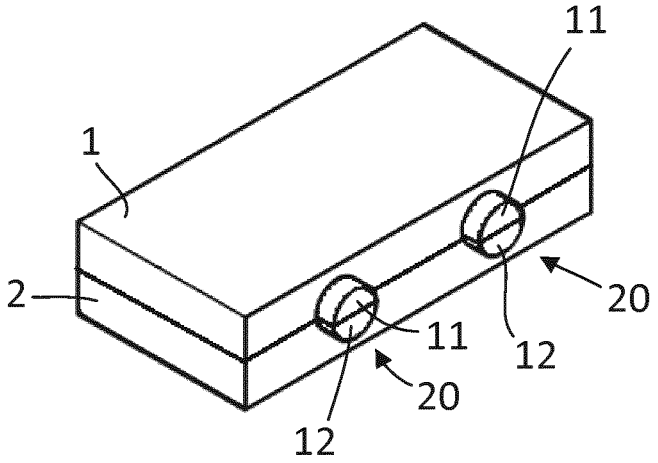
FIG. 1 shows a schematic view of a core pack.

FIG. 1 in a perspective illustration shows a schematic view of a core pack comprising a core 1 and a core 2, wherein both cores 1 and 2 are configured in each case with two chaplet portions 11 and 12, respectively. The chaplet portions 11 and 12, respectively, are mutually oriented and positioned in such a manner that prints 20 are formed. The prints 20 serve for disposing a chaplet element (not shown in FIG. 1).

Figure 2:
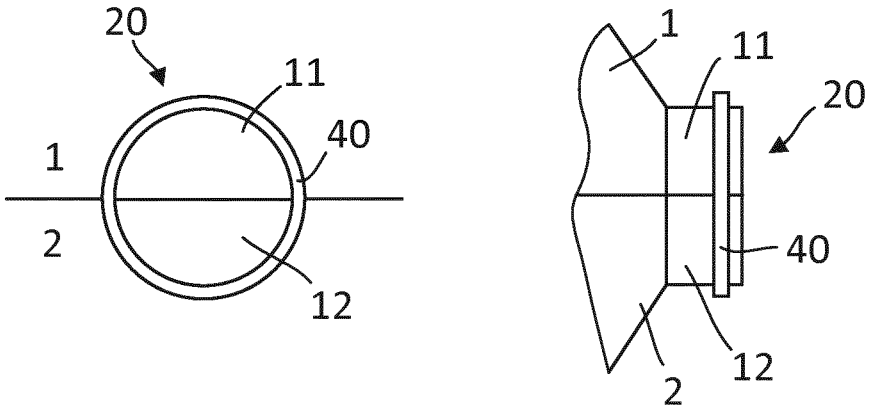
FIG. 2 shows two detailed views of prints.

FIG. 2 in the left half image shows a frontal view of a print 20 which is formed from two chaplet portions 11, 12. A ring-shaped, in particular annular, chaplet element 40 is disposed about the print 20. A lateral view is shown in the right half image, wherein it can be seen how the chaplet element 40 encloses the print 20 and thus mutually fixes or compresses, respectively, the two cores 1 and 2. Depending on the design embodiment of the chaplet element 40, pretensioning can already be applied to the two chaplet portions 11 and 12, or the adjoining cores 1 and 2, respectively, in this state. Alternatively, the chaplet element 40 can also be configured in such a manner that said chaplet element 40 is only push-fitted onto the print 40 so as to be flush with the latter, wherein there is not yet any force acting on the two chaplet portions 11 and 12 herein.

Figure 3:
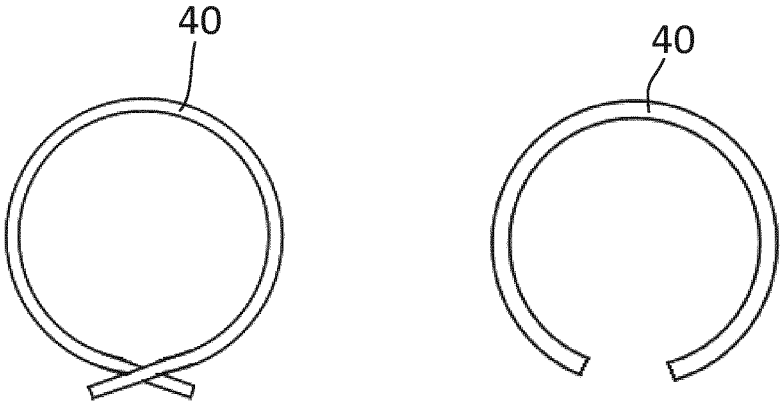
FIG. 3 shows two embodiments of chaplet elements.

FIG. 3 shows two potential design embodiments of chaplet elements 40 which are in particular configured as spring elements, or as spring rings, respectively. The chaplet elements 40 are made from metal, for example, and depending on the specific application, in terms of the raw material are adapted to the melt of the casting material of the later component, for example. The casting material is, for example, an aluminum raw material, in particular, an aluminum alloy. The material of the chaplet element 40 can be a raw material that is dissimilar to said casting material, or else can be the same raw material as that of the casting per se. Both chaplet elements 40 by way of the shape and geometry thereof enable an in particular radial elasticity or deformation capability, respectively, which enables the disposal on disposal regions that are dimensioned so as to be of dissimilar sizes as well as the application of a pretensioning force suitable for fixing/holding the cores.

LIST OF REFERENCE SIGNS

1, 2 Cores
11, 12 Chaplet portions
20 Print
40 Chaplet element The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A mold having a core pack, comprising:

an outer mold configured to receive a casting metal;

at least two cores configured to be arranged in the outer mold after the outer mold is formed and to form at least one fluid channel within a casting, wherein the at least two cores have mutually oriented chaplet portions which form an appendage in the form of a print when outermost ones of the chaplet portions are in mutual contact in a region containing the chaplet portions, the chaplet portions being configured to not extend to an outer surface of a cast component after being cast within the mold, and a chaplet element is disposed on top of and/or on the print, on account of which the two cores are mutually fixable.

2. The mold having a core pack according to claim 1, wherein the chaplet element is configured for a form-fitting and/or force-fitting disposal.

3. The mold having a core pack according to claim 1, wherein the chaplet element is elastic.

4. The mold having a core pack according to claim 3, wherein the chaplet element is ring-shaped.

5. The mold having a core pack according to claim 4, wherein the chaplet element is a spring ring.

6. The mold having a core pack according to claim 3, wherein the chaplet element is ring-shaped.

7. The mold having a core pack according to claim 1, wherein the chaplet element is a spring ring.

8. The mold having a core pack according to claim 1, wherein a raw material of the chaplet element corresponds to a casting raw material.

9. The mold having a core pack according to claim 1, wherein a melting temperature and/or evaporating temperature of a raw material of the chaplet element is below a melting temperature of a casting raw material.

10. The mold having a core pack according to claim 1, wherein the chaplet portions in cross section are circle-segment-shaped.

11. The mold having a core pack according to claim 1, wherein a length-to-diameter ratio of the appendage is less than 0.6.

12. The mold having a core pack according to claim 1, wherein the core pack is a core pack of a cylinder head.

* * * * *